US009134680B2

(12) United States Patent
Morita

(10) Patent No.: US 9,134,680 B2
(45) Date of Patent: Sep. 15, 2015

(54) DRIVING FORCE TRANSMISSION UNIT AND IMAGE FORMING APPARATUS INCLUDING SAME

(71) Applicant: Yoshiaki Morita, Kanagawa (JP)

(72) Inventor: Yoshiaki Morita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 80 days.

(21) Appl. No.: 14/058,578

(22) Filed: Oct. 21, 2013

(65) Prior Publication Data

US 2014/0140729 A1 May 22, 2014

(30) Foreign Application Priority Data

Nov. 21, 2012 (JP) ..... 2012-255505

(51) Int. Cl.
*G03G 15/00* (2006.01)

(52) U.S. Cl.
CPC ..... *G03G 15/757* (2013.01)

(58) Field of Classification Search
CPC ..... G03G 15/757
USPC ..... 399/167
See application file for complete search history.

(56) References Cited

FOREIGN PATENT DOCUMENTS

| | | | |
|---|---|---|---|
| JP | 10020604 A | * | 1/1998 |
| JP | 11030940 A | * | 2/1999 |
| JP | 2000-250279 | | 9/2000 |
| JP | 2004-258292 | | 9/2000 |
| JP | 2002-340005 | | 11/2002 |
| JP | 2003-278886 | | 10/2003 |
| JP | 2007-239903 | | 9/2007 |
| JP | 2007-240007 | | 9/2007 |
| JP | 2009-069476 | | 4/2009 |
| JP | 2009-116246 | | 5/2009 |

* cited by examiner

*Primary Examiner* — Susan Lee
(74) *Attorney, Agent, or Firm* — Harness, Dickey & Pierce, P.L.C.

(57) ABSTRACT

A driving force transmission unit includes on a driving force transmission path a first driving rotary body with a plurality of first contact portions, a first driven rotary body with a plurality of first contact targets, a second driving rotary body with a plurality of second contact portions, and a second driven rotary body with a plurality of second contact targets. Each of the plurality of the first contact portions and each of the plurality of the first contact targets are disposed such that peaks of periodical shock generated as a first connecting portion defined by one of the first contact portions contacting one of the first contact targets changes from one to another do not overlap with peaks of periodical shock generated as a second connecting portion defined by one of the second contact portions contacting one of the second contact targets changes from one to another.

6 Claims, 12 Drawing Sheets

DRIVING FORCE TRANSMISSION UNIT AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2012-255505, filed on Nov. 21, 2012, in the Japan Patent Office, the entire disclosure of which is hereby incorporated by reference herein.

BACKGROUND

1. Technical Field

Exemplary aspects of the present invention generally relate to a driving force transmission unit to transmit a driving force to a target and an image forming apparatus including the driving force transmission unit, and more particularly to an image forming apparatus such as a copier, a facsimile machine, a printer, or a multi-functional system including a combination thereof.

2. Description of the Related Art

Generally, a driving force transmission unit includes a rotary body at a drive source side (hereinafter referred to as drive-source rotary body) and at least two connecting portions at which the drive-source rotary body and a rotary body at a rotation target side (hereinafter referred to as rotation-target rotary body) are connected, and the connecting portions are disposed on a transmission path through which the driving force from the drive source is transmitted to the rotation target such as a roller and a drum.

Examples of such connecting portions include a meshing portion at which two gears mesh with each other, a fitting portion on a rotary shaft to which a gear or a pulley is fitted, and a coupling (shaft coupling) that connects two rotary shafts at the shaft ends. At such connecting portions, rotation of the drive-source rotary body driven by the drive source causes a contact portion of the drive-source rotary body to push the rotation-target rotary body, thereby transmitting a rotary driving force to the rotation-target rotary body.

Generally, there are two or more connecting portions that connect the drive-source rotary body and the rotation-target rotary body. The connecting portions are generally provided with some play or backlash. Furthermore, manufacturing errors and meshing errors exist. As a result, not all the contact portions of the drive-source rotary body and the rotation-target rotary body are always in contact with each other, and the contact portions that come into contact change alternately.

As the contact portions that come into contact change, undesirable collision may occur between the contact portion of the drive-source rotary body and the contact portion of the rotation-target rotary body, generating vibration. If the vibration is significant, devices equipped with the driving force transmission unit may cause various problems. For example, the vibration in the driving force transmission unit in an image forming apparatus during image formation causes imaging failure, thereby producing an image defect.

In attempting to prevent undesirable vibration when there is an axis shift between a coupling of a drive shaft (i.e., the drive-source rotary body) and a coupling of a driven shaft (i.e., the rotation-target rotary body), in one approach, a known driving force transmission unit includes a plurality of claws on each of the drive shaft and the driven shaft. That is, the claws of the drive shaft contact the claws of the driven shaft at multiple places. Such a configuration is disclosed in Japanese Patent 4604063, for example.

At such couplings, the axis shift causes uneven contact between the claws of the drive shaft and the claws of the driven shaft, causing uneven transmission of the driving force at the contact portions. According to Japanese Patent 4604063, uneven transmission of the driving force causes transmission of the undesirable torque to the driven shaft. Furthermore, an excessive force acts in a certain direction on a plane perpendicular to the axis line. The direction of the excessive force is not constant, but varies while rotating, generating cyclic vibration. The driving force transmission unit in Japanese Patent 4604063 is to reduce the vibration when the axis shift exists at the couplings of the shafts.

In the known driving force transmission unit, the vibration that occurs at each of the contact portions is suppressed individually, thereby reducing the vibration of the driving force transmission unit as a whole. However, as described above, generally, there are more than two connecting portions at which the drive-source rotary body and the rotation-target rotary body are connected. When vibration at each of the plurality of the connecting portions is superimposed and amplified, significant vibration may occur. The vibration due to amplification of the vibrations at the plurality of the connecting portions tends to be greater than the individual vibration generated at each of the connecting portions. Thus, the devices equipped with such a driving force transmission unit cause more serious problems.

At the connecting portion, in particular, at the connecting portion using the couplings, the vibration due to the axis shift between the drive shaft and the driven shaft is greater than the vibration at other connecting portions. Therefore, reducing the vibration at the coupling is advantageous in terms of preventing various problems derived from the vibration generated in the drive power transmission unit. Although advantageous, even when the vibration is reduced at the coupling, if the reduced vibration is superimposed on the vibration generated at other connecting portions and amplified, greater vibration is generated, causing various problems.

SUMMARY

In view of the foregoing, in an aspect of this disclosure, there is provided an improved driving force transmission unit including a first driving rotary body, a first driven rotary body, a second driving rotary body, and a second driven rotary body. The first driving rotary body includes a plurality of first contact portions, to receive a driving force from a drive source and rotate. The first driven rotary body includes a plurality of first contact targets, one of which alternately contacts one of the plurality of first contact portions to form a first connecting portion therebetween and receive the driving force from the first driving rotary body so as to be rotated. The second driving rotary body includes a plurality of second contact portions, to receive the driving force and rotate. The second driven rotary body including a plurality of second contact targets, one of which alternately contacts one of the plurality of second contact portions to form a second connecting portion therebetween and receive the driving force from the second driving rotary body so as to be rotated. The first driving rotary body, the first driven rotary body, the second driving rotary body, and the second driven rotary body are disposed on a driving force transmission path along which the driving force from the drive source is transmitted to a drive target. Each of the plurality of the first contact portions and each of the plurality of the first contact targets are disposed such that peaks of periodical shock generated as the first connecting portion changes from one to another do not overlap with peaks of periodical shock generated as the second connecting portion changes from one to another.

According to another aspect, an image forming apparatus includes an image bearing member to rotate and bear an image on a surface thereof, a transfer device to transfer the image on the image bearing member onto a recording medium, a sheet conveyor to rotate and transport the recording medium, and the driving force transmission unit to rotate at least one of image bearing member and the sheet conveyor.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
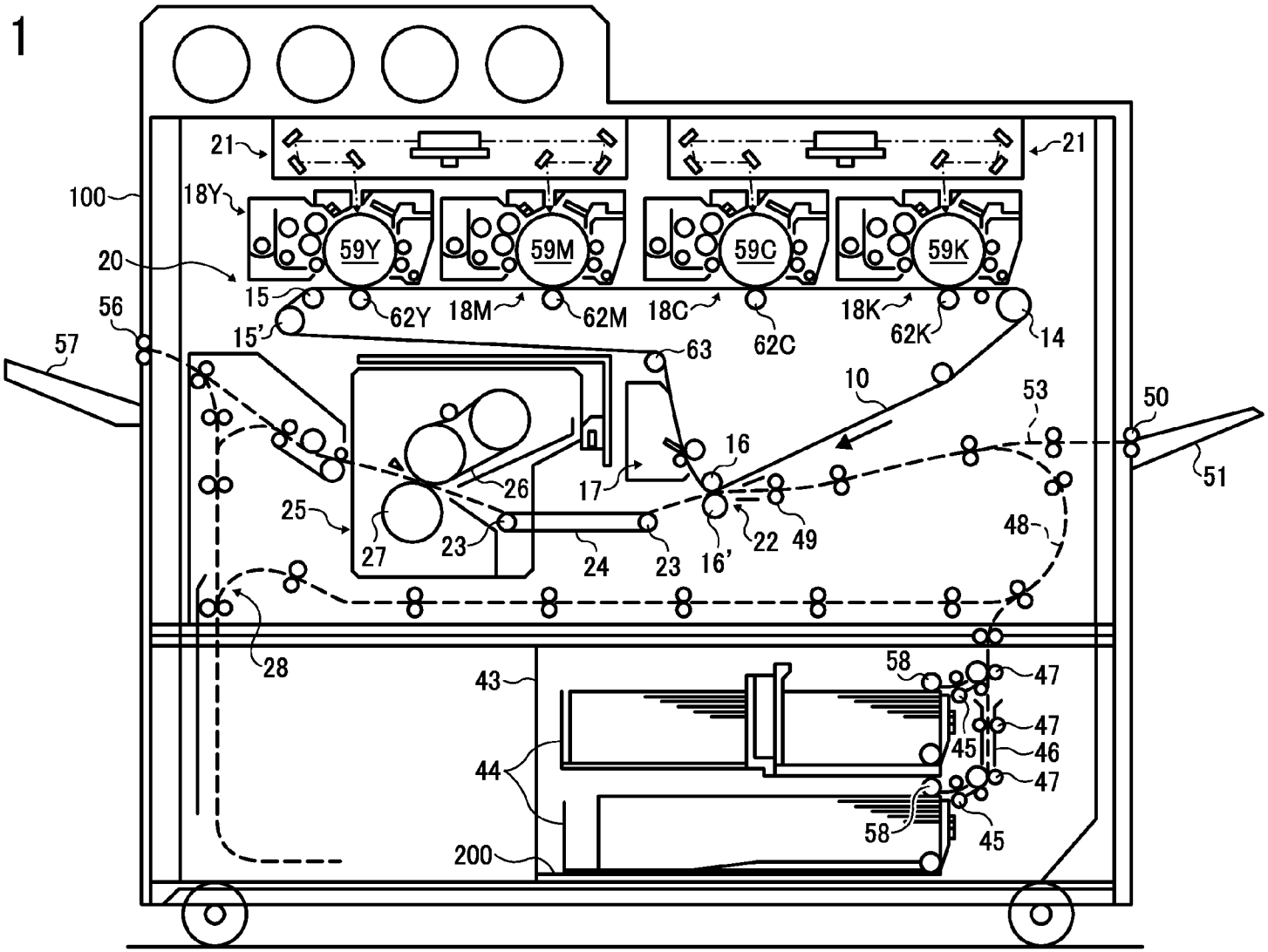
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an image forming apparatus according to an illustrative embodiment of the present disclosure. FIG. 1 is a schematic diagram illustrating an example of an electrophotographic image forming apparatus according to an illustrative embodiment of the present disclosure.

The image forming apparatus shown in FIG. 1 is a tandem-type image forming apparatus including a main body 100 disposed above a sheet feeding unit 200 which stores multiple recording media. It is to be noted that suffixes Y, M, C, and, K denote colors yellow, magenta, cyan, and black, respectively. To simplify the description, the suffixes Y, M, C, and, K indicating colors are omitted herein unless otherwise specified.

In the main body 100 of the image forming apparatus, an intermediate transfer belt 10 serving as a belt-type image bearing member is entrained around a plurality of support rollers 14, 15, 15', 16, and 63, and is formed into an endless loop. The intermediate transfer belt 10 is movable in a clockwise direction in FIG. 1. In FIG. 1, a belt cleaning device 17 is disposed at the left side of a secondary-transfer opposing roller 16 which serves as one of the support rollers. The belt cleaning device 17 removes residual toner remaining on the intermediate transfer belt 10 after an image is transferred.

The image forming apparatus includes a tandem image forming unit 20 in which toner image forming stations 18Y, 18M, 18C, and 18K, one for each of the colors yellow, magenta, cyan, and black, are arranged horizontally in tandem above the looped intermediate transfer belt 10 along the direction of movement of the intermediate transfer belt 10 stretched taut between the support rollers 14 and 15.

As illustrated in FIG. 1, an optical writing unit or an exposure unit 21 serving as an optical writing mechanism is disposed above the tandem image forming unit 20. The toner image forming stations 18Y, 18M, 18C, and 18K in the tandem image forming unit 20 include photosensitive drums 59Y, 59M, 59C, and 59K, one for each of the colors yellow, magenta, cyan, and black, respectively. Latent images of the colors yellow, magenta, cyan, and black are formed on the photosensitive drums 59Y, 59M, 59C, and 59K, respectively. Each surface of the photosensitive drums 59Y, 59M, 59C, and 59K is charged uniformly by charging devices. Subsequently, based on image data, the photosensitive drums 59Y, 59M, 59C, and 59K are exposed by the optical writing unit 21, thereby forming the latent images on the photosensitive drums 59Y, 59M, 59C, and 59K.

The latent images on the photosensitive drums 59Y, 59M, 59C, and 59K are developed with the respective color of toner by developing devices, thereby forming visible images, also known as toner images, on the surface of the photosensitive drums 59Y, 59M, 59C, and 59K. Primary transfer rollers 62Y, 62M, 62C, and 62K are disposed opposite the photosensitive drums 59Y, 59M, 59C, and 59K with the intermediate transfer belt 10 interposed therebetween, thereby forming primary transfer nips at which toner images are transferred from the photosensitive drums 59Y, 59M, 59C, and 59K onto the intermediate transfer belt 10.

The support roller 14 in FIG. 1 is a drive roller that rotates the intermediate transfer belt 10. When forming a single color image of black color, rollers other than the drive roller 14, i.e., the support rollers 15 and 15', are moved so that the intermediate transfer belt 10 is separated from the photosensitive drums 59Y, 59M, and 59C for the colors yellow, magenta, and cyan.

A secondary transfer unit 22 is disposed opposite the tandem image forming unit 20 via the intermediate transfer belt 10. The secondary transfer unit 22 includes a secondary-transfer opposing roller 16 and a secondary transfer roller 16'. In FIG. 1, the secondary transfer roller 16' is pressed against the secondary-transfer opposing roller 16 to apply a transfer electric field thereto. Accordingly, a toner image on the intermediate transfer belt 10 is transferred onto a recording medium.

A fixing unit 25 is disposed next to the secondary transfer unit 22. The fixing unit 25 serving as a fixing mechanism fixes the toner image transferred on the recording medium. The fixing unit 25 includes a fixing belt 26 and a pressing roller 27. The fixing belt 26 is formed into an endless loop to transport a recording medium. The pressing roller 27 as a pressing member is pressed against the fixing belt 26. A conveyor belt 24 serving as a recording medium transport member is entrained around support rollers 23 and rotated. The recording medium after the toner image is transferred thereto is transported to the fixing unit 25.

An example of the image forming apparatus illustrated in FIG. 1 includes a sheet reversing unit 28 below the secondary transfer unit 22 and the fixing unit 25, parallel to the tandem image forming unit 20. The sheet reversing unit 28 reverses a recording medium to form images on both sides of the recording medium.

In the image forming apparatus described above, an image data is sent to the main body 100 of the image forming apparatus. When receiving a signal to start image formation, a drive motor, not shown, drives the support roller 14 to rotate, causing other support rollers to rotate. Accordingly, the intermediate transfer belt 10 is rotated. In the meantime, the toner image forming stations 18Y, 18M, 18C, and 18K form single-color toner images yellow, magenta, cyan, and black on the photosensitive drums 59Y, 59M, 59C, and 59K, respectively.

As the intermediate transfer belt 10 is rotated, the single-color images are transferred from the photosensitive drums 59Y, 59M, 59C, and 59K onto the intermediate transfer belt 10 at the primary transfer nips or primary transfer portions opposite the primary transfer rollers 62Y, 62M, 62C, and 62K such that the toner images are superimposed one atop the other, thereby forming a composite toner image on the intermediate transfer belt 10.

In the sheet feeding unit 200, one of sheet feed rollers 58 is selectively rotated so as to feed a recording medium from one of sheet cassettes 44 disposed in a paper bank 43. A separation roller 45 separates the recording medium one by one and feeds it to a sheet delivery path 46. Then, the recording medium is guided to a sheet delivery path 48 in the main body 100 of the image forming apparatus by transport rollers 47 and arrives at a pair of registration rollers 49. As the recording medium arrives at the pair of registration rollers 49, the pair of registration rollers 49 stops rotating.

Alternatively, a sheet feed roller 50 is rotated to pick up a recording medium placed on a side tray 51 disposed at the lateral side of the main body 100. The recording medium is fed to a manual feed path 53 by the separation roller one by one. In this configuration, the recording medium also strikes the pair of registration rollers 49, and the pair of registration rollers 49 stops rotating. Subsequently, the pair of registration rollers 49 rotates again in appropriate timing such that the recording medium is aligned with the composite toner image formed on the intermediate transfer belt 10 and sent to a secondary transfer nip at which the intermediate transfer belt 10 and the secondary transfer roller 16' of the secondary transfer unit 22 meet. Accordingly, the composite toner image is transferred onto the recording medium at the secondary transfer nip in the secondary transfer unit 22.

After the composite toner image is transferred on the recording medium, the recording medium is transported to the fixing device 25 in which heat and pressure are applied to the recording medium bearing the unfixed toner image to fix the unfixed toner image on the recording medium. After fixing, the recording medium is output onto a sheet tray 57 by a sheet output roller 56. Alternatively, the direction of delivery of the recording medium is switched by a switching claw, not illustrated, thereby directing the recording medium to the sheet reversing unit 28 for duplex printing. After an image is recorded on the other side (second side) of the recording medium, the recording medium is output onto the sheet output tray 57 by the sheet output roller 56.

The intermediate transfer belt 10 after image transfer is cleaned by the belt cleaning device 17, thereby removing residual toner remaining on the intermediate transfer belt 10 after image transfer in preparation for the subsequent image forming operation.

Figure 2:
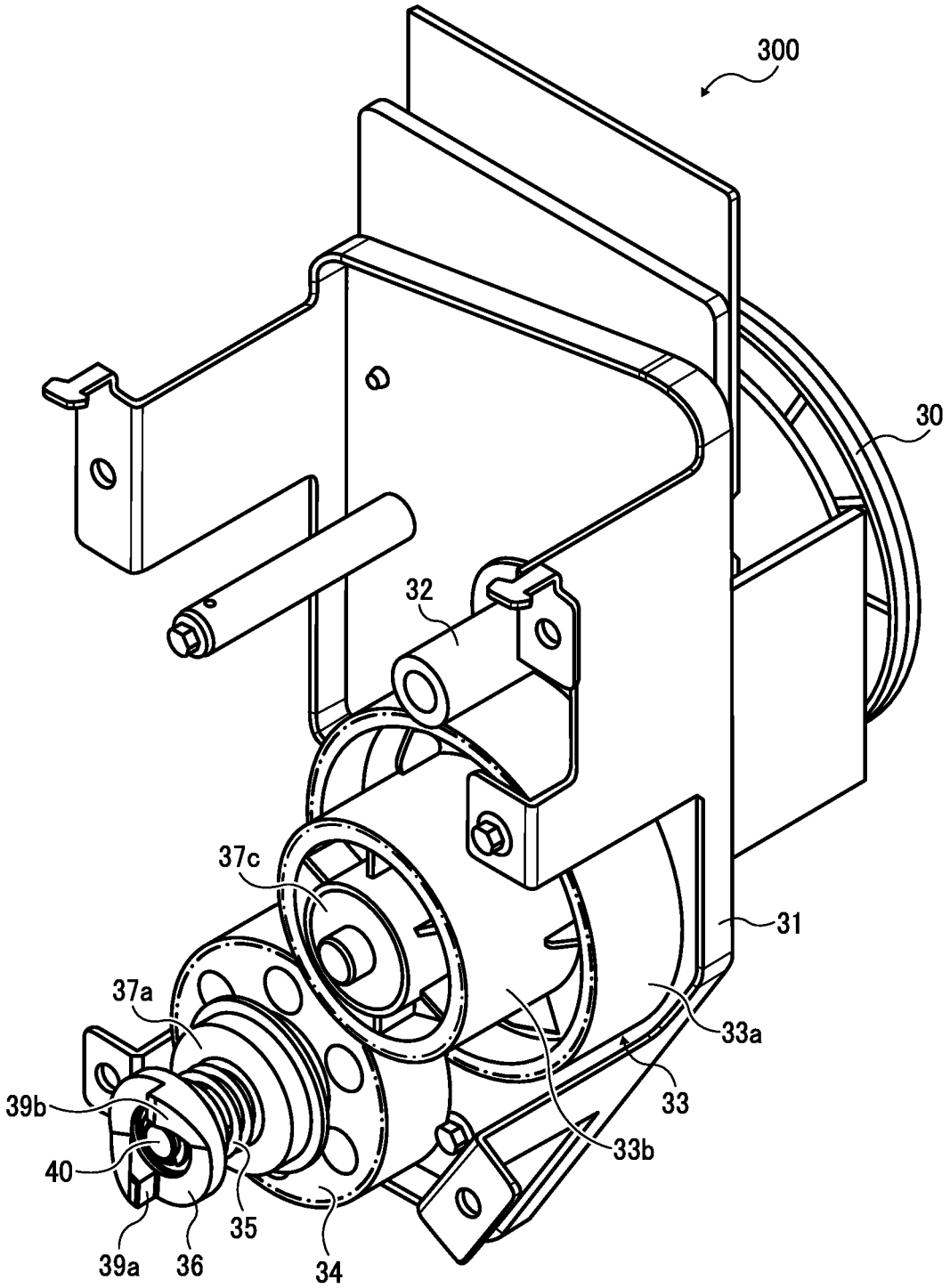
FIG. 2 is a perspective view schematically illustrating a driving force transmission unit employed in the image forming apparatus of FIG. 1.
Figure 3:
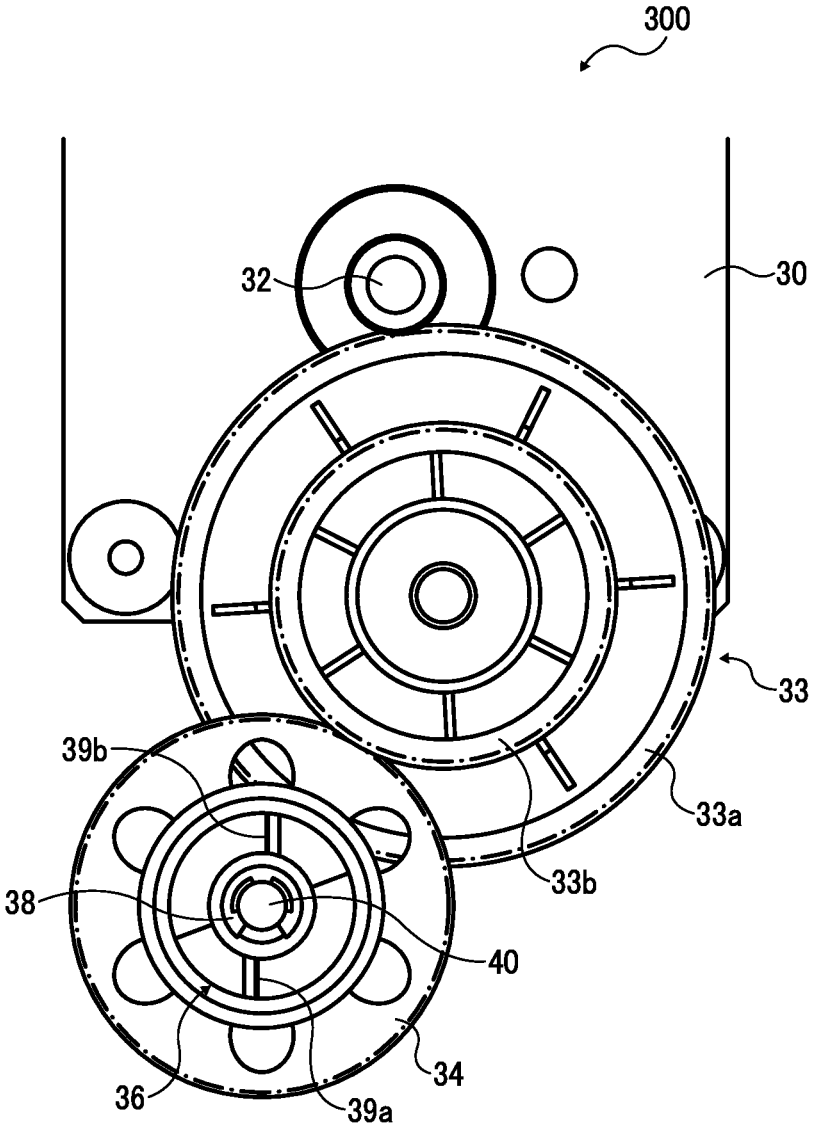
FIG. 3 is a front view schematically illustrating the driving force transmission unit of FIG. 2 as viewed from an axial direction of an output shaft of a motor.

Next, with reference to FIGS. 2 and 3, a description is provided of a driving force transmission unit 300 according to an illustrative embodiment of the present disclosure. FIG. 2 is a perspective view schematically illustrating a main component of the driving force transmission unit 300 employed in the image forming apparatus. FIG. 3 is a front view schematically illustrating the main component of the driving force transmission unit 300 as viewed from an axial direction of an output shaft of a motor 30.

The driving force transmission unit 300 includes a bracket 31 and various parts supported by the bracket 31. The motor 30 serves as a source of power (a drive source) of a driving force of the driving force transmission unit 300. More specifically, the driving force transmission unit 300 includes the bracket 31, a motor gear 32 serving as an output shaft of the motor 30, an idler gear 33, a drive gear 34, and a drive output shaft 40. The driving force generated by the motor 30 is transmitted from the motor gear 32 to the idler gear 33, and then to the drive gear 34 and the drive output shaft 40 fixed thereto.

The idler gear 33 includes a large-diameter idler gear 33*a* and a small-diameter idler gear 33*b*, and a third drive bearing 37*c*. The large-diameter idler gear 33*a* and the small-diameter idler gear 33*b* are disposed coaxially. The motor gear 32 meshes with the large-diameter idler gear 33*a*, forming a meshing portion. The drive gear 34 meshes with the small-diameter idler gear 33*b*, forming a meshing portion.

A drive joint 36 is attached to an end portion of a rotary shaft of the drive output shaft 40 serving as a rotary body at the drive source side (it may also be referred to as drive-source rotary body). The drive joint 36 is connected to a driven joint attached to the end of a rotary shaft of a rotary body at a drive target side (it may also be referred to as drive-target rotary body) connected to a drive target. The drive joint 36 constitutes a shaft coupling (or simply coupling) that transmits a driving force to the driven joint.

Upon transmission of the driving force from the drive joint 36 to the driven joint, at least one of two claws 39*a* and 39*b* disposed on the drive joint 36 contacts one of two claws of the driven joint, thereby transmitting the driving force to the driven joint. More specifically, the drive joint 36 and the driven joint constitute a connecting portion A at which a rotary driving force of the drive joint 36 is transmitted to the driven joint.

Figure 4:
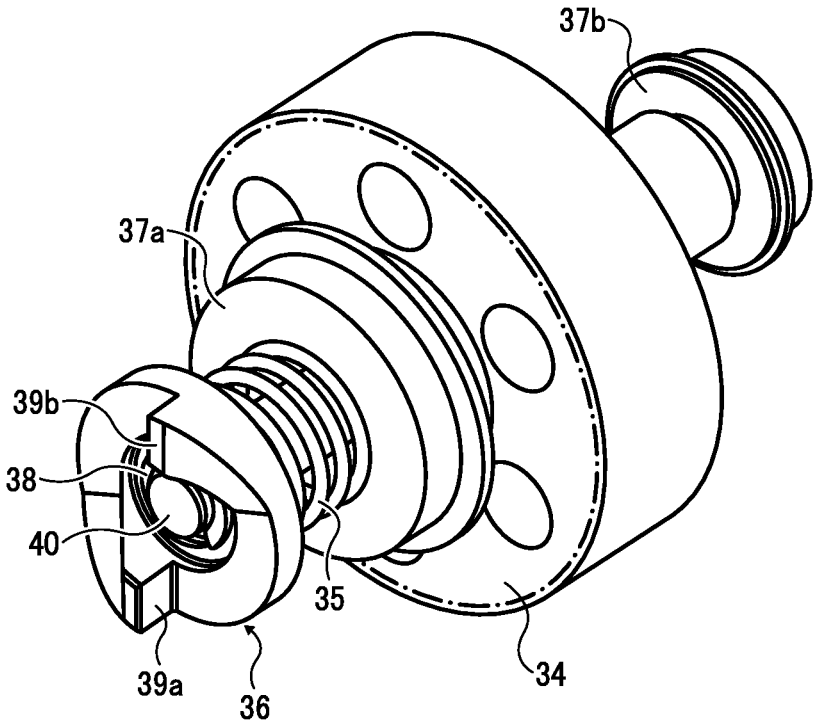
FIG. 4 is a partially enlarged perspective view schematically illustrating a drive output shaft of the driving force transmission unit and parts attached thereto.
Figure 5:
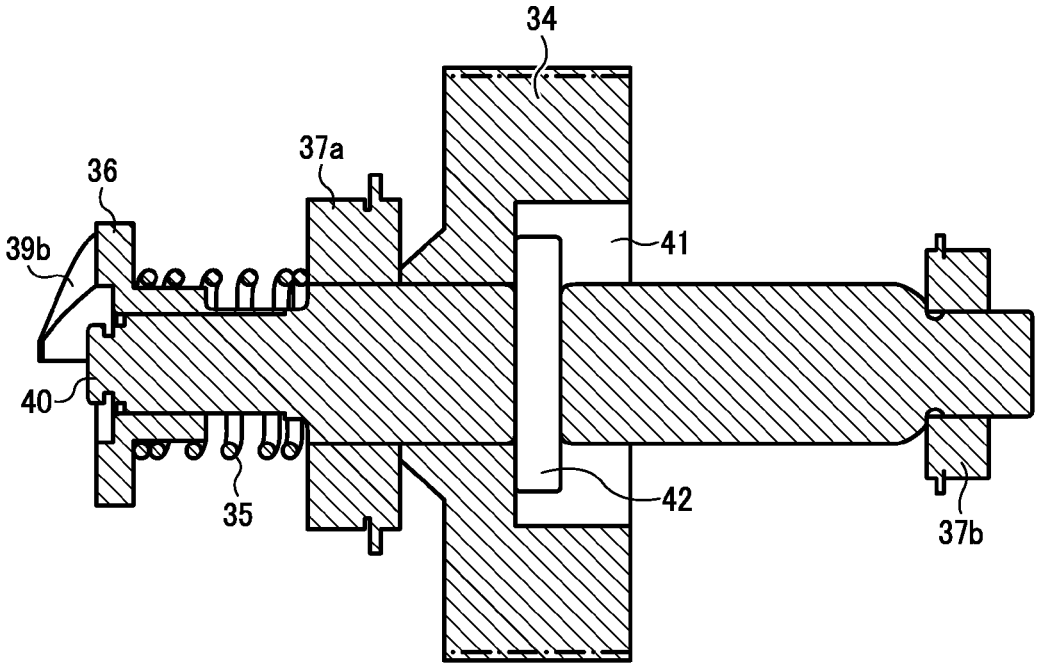
FIG. 5 is a cross-sectional view along the axial direction, schematically illustrating the drive output shaft and the parts attached thereto.
Figure 6:
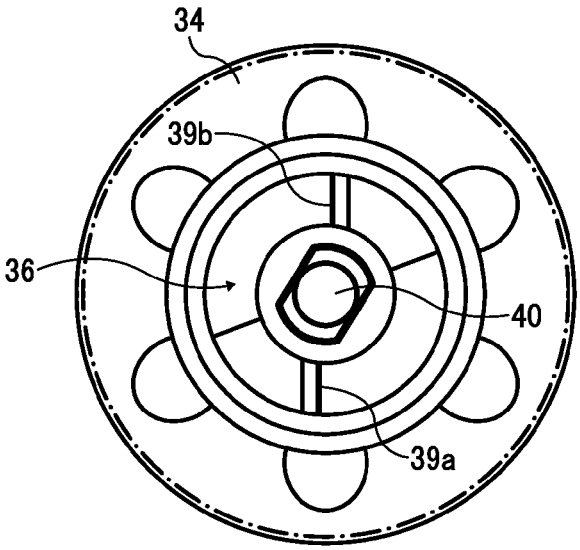
FIG. 6 is a front view schematically illustrating the drive output shaft with the parts attached thereto as viewed from the axial direction.
Figure 7:
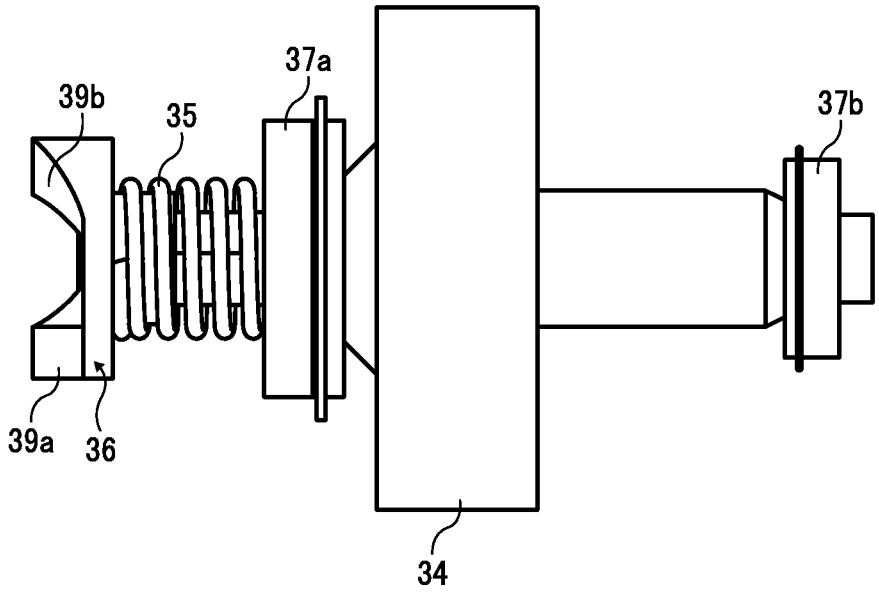
FIG. 7 is a lateral view schematically illustrating the drive output shaft with the parts attached thereto.
Figure 8:
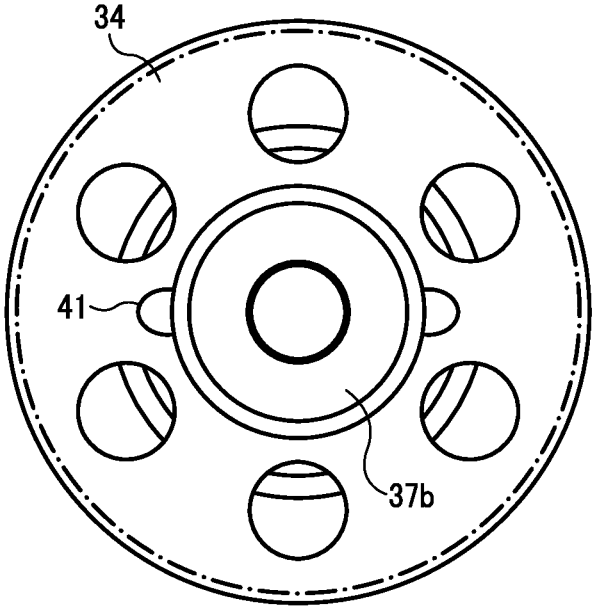
FIG. 8 is a rear view schematically illustrating the drive output shaft with the parts attached thereto.

FIG. 4 is a partially enlarged perspective view schematically illustrating the drive output shaft 40 and the parts attached thereto. FIG. 5 is a cross-sectional view along the axial direction, schematically illustrating the drive output shaft 40 and the parts attached thereto. FIG. 6 is a front view schematically illustrating the drive output shaft 40 and the parts attached thereto as viewed from the axial direction. FIG. 7 is a side view schematically illustrating the drive output shaft 40 and the parts attached thereto. FIG. 8 is a rear view schematically illustrating the drive output shaft 40 and the parts attached thereto.

A drive pin groove 41 is formed in the surface of a drive gear 34 at a second drive bearing 37*b* side (shown in FIG. 5). The drive pin groove 41 is long in a direction perpendicular to the rotary shaft. A drive pin 42 is attached integrally to the drive output shaft 40 such that the drive pin 42 projects in a radial direction of the drive output shaft 40. The drive pin 42 is fitted to the drive pin groove 41 with play. In this configuration, the drive output shaft 40 rotates in accordance with the rotation of the drive gear 34. More specifically, the drive output shaft 40 and the drive gear 34 constitute a connecting portion B at which a rotary driving force of the drive gear 34 is transmitted to the drive output shaft 40.

The drive joint 36 includes a through hole formed through the axial center of the drive joint 36. According to the present illustrative embodiment, the through hole has a rounded rectangular shape in cross section perpendicular to the axial direction. The shape of the through hole includes, but is not limited to, a rounded rectangular shape. The cross section (the cross section perpendicular to the axial direction) of the end portion of the drive output shaft 40, to which the drive joint 36 is attached, has also a rounded rectangular shape so that the drive output shaft 40 can be fitted to the through hole of the drive joint 36. The end portion of the drive output shaft 40 having a rounded rectangular shape is fitted to the through hole of the drive joint 36 with play. The shape of the end portion of the drive output shaft 40 is not limited to a rounded rectangular shape, but may be a shape corresponding to the shape of the through hole of the drive joint 36.

The drive joint 36 rotates in accordance with the rotation of the drive output shaft 40. More specifically, the drive output shaft 40 and the drive joint 36 constitute a connecting portion C at which a rotary driving force of the drive output shaft 40 is transmitted to the drive joint 36.

A first drive bearing 37*a* and a second drive bearing 37*b* are attached jointly to the drive output shaft 40 via the drive gear 34. A spring 35 is disposed between the first drive bearing 37*a* and the drive joint 36. The first drive bearing 37*a* is attached to the drive output shaft 40 towards the drive joint 36 relative to the drive gear 34. When attaching the drive joint 36 to the rounded rectangular-shaped portion of the drive output shaft 40, the spring 35 is compressed.

A stopper ring 38 shown in FIG. 3 restricts displacement of the drive joint 36 towards the driven joint side to prevent the drive joint 36 from getting detached from the drive output shaft 40 due to the restoration force of the spring 35. Accordingly, the drive joint 36 is biased against the driven joint side by the spring 35, thereby maintaining a stable connection between the drive joint 36 and the driven joint.

Figure 9:
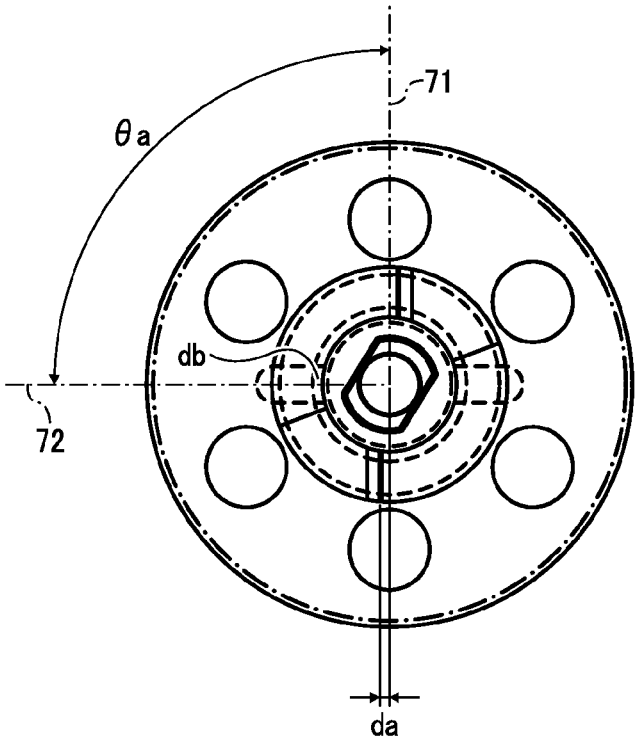
FIG. 9 is a schematic diagram illustrating a relative angle between a pin groove formed in a drive gear of the driving force transmission unit in a longitudinal direction thereof and a contact surface of a claw on a drive joint.

According to the present illustrative embodiment, as shown in FIG. 9, on an imaginary plane perpendicular to the axial direction of the drive output shaft 40, a long direction 72 of the drive pin groove 41 of the drive gear 34 and a parallel direction 71 parallel to a contact plane of the claws 39*a* and 39*b* on the drive joint 36 face different directions. In this configuration, as illustrated in FIG. 9, an angle θa formed between the long direction 72 of the drive pin groove 41 of the drive gear 34 and the parallel direction 71 parallel to the contact plane of the claws 39*a* and 39*b* on the drive joint is approximately 90°.

According to the present illustrative embodiment, on an imaginary plane perpendicular to the axial direction of the drive output shaft 40, the long direction 72 of the drive pin groove 41 of the drive gear 34 and a long axis direction 70 of the through hole of the drive joint 36 face different directions. In this configuration, as illustrated in FIG. 10, an angle θb formed between the long direction 72 of the drive pin groove 41 of the drive gear 34 and the long axis direction of the through hole in the drive joint 36 is approximately 60°.

According to the present illustrative embodiment, on an imaginary plane perpendicular to the axial direction of the drive output shaft 40, the parallel direction 71 parallel to the contact plane of the claws 39*a* and 39*b* on the drive joint 36 and the long axis direction 70 of the through hole in the drive joint 36 face different directions. In this configuration, as illustrated in FIG. 11, an angle θc formed between the parallel direction 71 parallel to the contact plane of the claws 39*a* and 39*b* on the drive joint 36 and the long axis direction 70 of the through hole in the drive joint 36 is approximately 30°.

Figure 11:
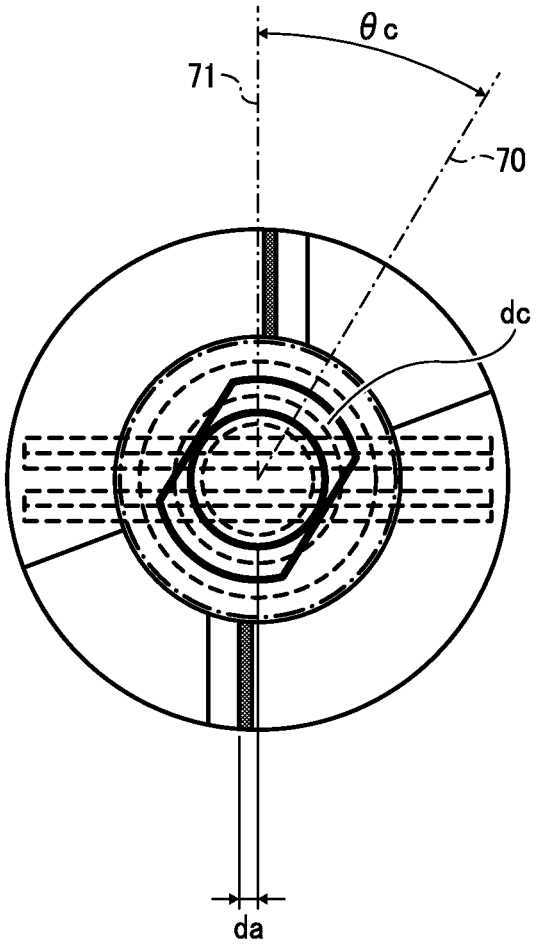
FIG. 11 is a schematic diagram illustrating a relative angle between the contact surface of the claw of the drive joint and the through hole of the drive joint.

It is to be noted that in FIGS. 9 and 11, the reference character "da" refers to an amount of deviation (a distance of each contact plane of the claws 39*a* and 39*b* in the normal direction) between a line passing through each contact plane of the claws 39*a* and 39*b* of the drive joint 36 and a line passing through the center of the rotary shaft of the drive joint 36 parallel to the contact surface of each of the claws 39*a* and 39*b* on an imaginary plane perpendicular to the axial direction of the drive output shaft 40. With the deviation da, even when there is an axial deviation between the drive joint 36 and the driven joint, the drive joint 36 and the driven joint can be connected at the connecting portion A at which the drive joint 36 and the driven joint are connected. Thereafter, the deviation da is used as a substitute for the amount of axial deviation between the drive joint 36 and the driven joint.

Figure 10:
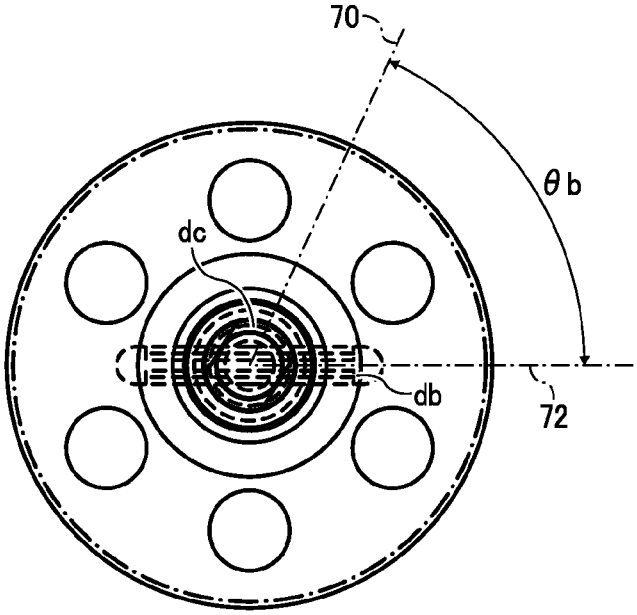
FIG. 10 is a schematic diagram illustrating a relative angle between the pin groove and a through hole in the drive joint in the long axis direction.

It is to be noted that in FIG. 10, the reference character "db" refers to a gap (gap in the direction perpendicular to the long direction of the drive pin groove 41) between the drive pin groove 41 of the drive gear 34 and the drive pin 42 on the drive output shaft 40 on the imaginary plane perpendicular to the axial direction of the drive output shaft 40. The gap db is provided at the connecting portion B at which the output shaft 40 and the drive gear 34 are connected, thereby connecting (assembling) easily the drive gear 34 on the drive output shaft 40 by the drive pin 42.

In FIG. 10, the reference character "dc" refers to a gap (gap in the direction perpendicular to the long direction of the rounded rectangular-shaped through hole) between the end portion of the drive output shaft 40 having a rounded rectangular shape and the through hole of the drive joint 36 on the imaginary plane perpendicular to the axial direction of the drive output shaft 40. The gap dc is provided at the connecting portion C at which the output shaft 40 and the drive joint 36 are connected, thereby connecting (assembling) easily the drive joint 36 on the drive output shaft 40 and also allowing the drive joint 36 to be movable relative to the drive output shaft 40.

Figure 12A:
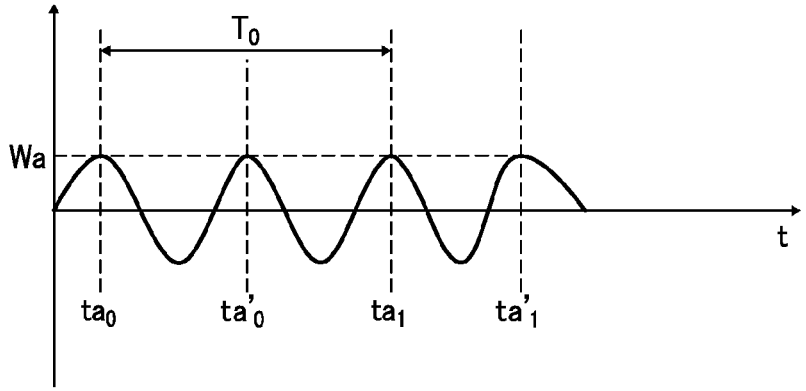
FIG. 12A shows a frequency of vibration caused by a periodical shock at a connecting portion A at which the drive joint and a target joint are connected.
Figure 12B:
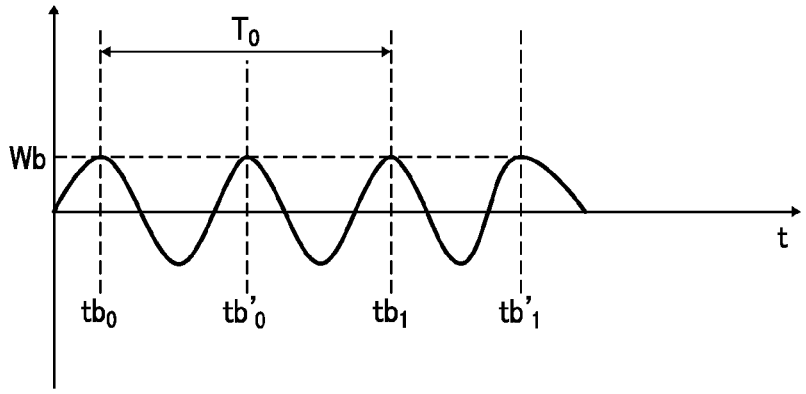
FIG. 12B shows a frequency of vibration caused by a periodical shock at a connecting portion B at which the drive output shaft and the drive gear are connected.
Figure 12C:
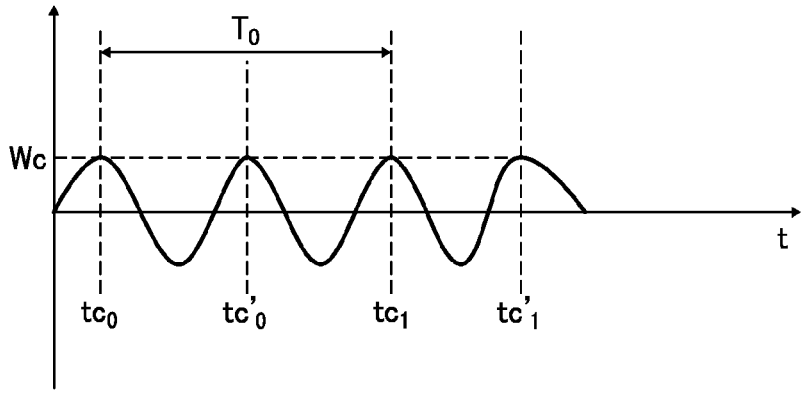
FIG. 12C shows a frequency of vibration caused by a periodical shock at a connecting portion C at which the drive output shaft and the drive joint are connected.

FIG. 12A shows a frequency of vibration caused by a periodical shock at the connecting portion A at which the drive joint 36 and a driven joint are connected. FIG. 12B shows a frequency of vibration caused by a periodical shock at the connecting portion B at which the drive output shaft 40 and the drive gear 34 are connected. FIG. 12C shows a frequency of vibration caused by a periodical shock at the connecting portion C at which the drive output shaft 40 and the drive joint 36 are connected. In FIGS. 12A through 12C, the vertical axis represents an amplitude, and the horizontal axis represents time.

According to the present illustrative embodiment, at the connecting portion A at which the drive joint 36 and the driven joint are connected, each of two claws 39*a* and 39*b* of the drive joint 36 contacts each claws of the driven joint, thereby transmitting the driving force. However, due to the deviation da, the axial deviation, and the like, the claws 39*a* and 39*b* of the drive joint 36 alternately contact the claws of the driven joint during rotation, causing the claws 39*a* and 39*b* of the drive joint 36 to strike against the claws of the driven joint. As illustrated in FIG. 12A, this collision of the claws causes a periodical shock ($ta_0$, $ta'_0$, $ta_1$, $ta'_1$, and so forth) in every half cycle of a rotation cycle $T_0$ of the drive output shaft 40.

According to the present illustrative embodiment, at the connecting portion B at which the drive output shaft 40 and the drive gear 34 are connected, an inner wall (contact portion) of the drive pin groove 41 of the drive gear 34 contacts two projecting portions (contact targets) of the drive pin 42 projecting beyond the drive output shaft 40 in the radial direction, thereby transmitting the driving force. However, due to the gap db and the like, the two projecting portions alternately contact the inner wall of the drive pin groove 41, causing the inner wall of the drive pin groove 41 to collide with the projecting portions of the drive pin 42. As illustrated in FIG. 12B, this collision causes a periodical shock ($tb_0$, $tb'_0$, $tb_1$, $tb'_1$, and so forth) in every half cycle of the rotation cycle $T_0$ of the drive output shaft 40.

According to the present illustrative embodiment, at the connecting portion C at which the drive output shaft 40 and the drive joint 36 are connected, the rounded rectangular-shaped portion of the drive output shaft 40 contacts the inner wall of the rounded rectangular-shaped through hole of the drive joint 36, thereby transmitting the driving force. However, due to the gap dc and the like, an upper half and a lower half of the rounded rectangular-shaped portion of the drive output shaft 40 cut in the long axis direction alternately contact the inner wall of the through hole of the drive joint 36, causing the upper half and the lower half of the rounded rectangular-shaped portion of the drive output shaft 40 to collide with the inner wall of the through hole of the drive joint 36. As illustrated in FIG. 12C, this collision causes a periodical shock ($tc_0$, $tc'_0$, $tc_1$, $tc'_1$, and so forth) in every half cycle of the rotation cycle $T_0$ of the drive output shaft 40.

Figure 13:
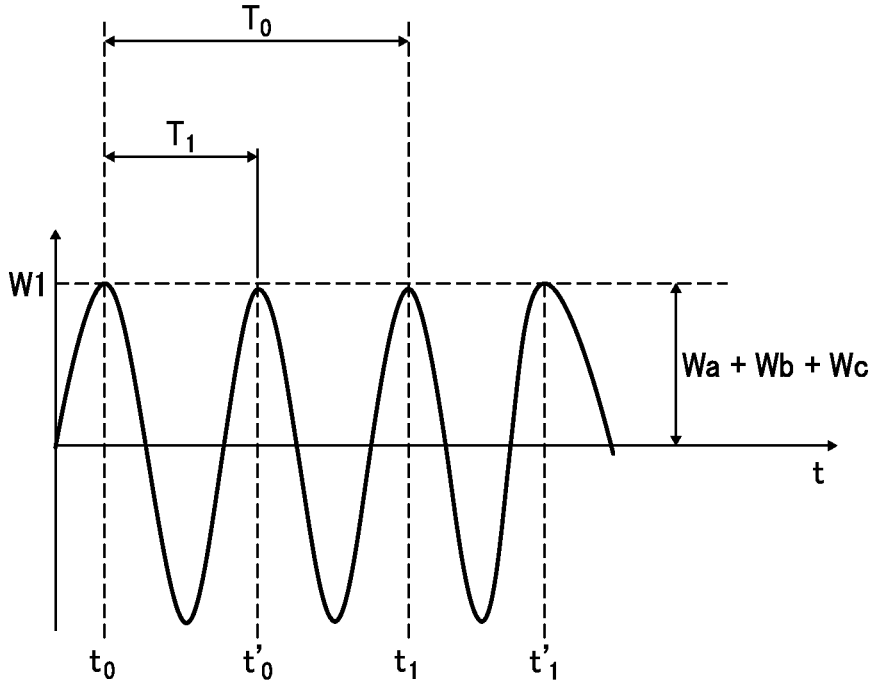
FIG. 13 shows a frequency of vibration caused by peaks of periodical shocks at the connecting portions A, B, and C superimposed one on another.

According to the present illustrative embodiment, the frequency of vibration caused by the periodical shock generated at each of the connecting portions A, B, and C corresponds to the half cycle of the rotation cycle $T_0$ of the drive output shaft 40. Therefore, as illustrated in FIGS. 12A through 12C, when the peaks of the periodical shock at each of the connecting portions A, B, and C overlap with each other ($ta_0$=$tb_0$=$tc_0$, and so on), and the phase of the vibration at each of the connecting portions A, B, and C coincides with each other, as illustrated in FIG. 13, an amplitude W1 of the vibration occurred at the drive output shaft 40 corresponds to the sum of amplitudes Wa, Wb, and Wc of the vibration at the connecting portions A, B, and C, respectively. Thus, the amplitude W1 becomes relatively large.

When the vibration having such a large amplitude, i.e., the amplitude W1 (its cycle is $T_1$=$T_0$/2), occurs at the drive output shaft 40, the vibration is transmitted to the bracket 31 supporting the drive output shaft 40 and then to the tandem image forming unit 20 and to the optical writing unit (exposure unit) 21 via the supporting structure of the main body 100 of the image forming apparatus, resulting in imaging failure.

Figure 14A:
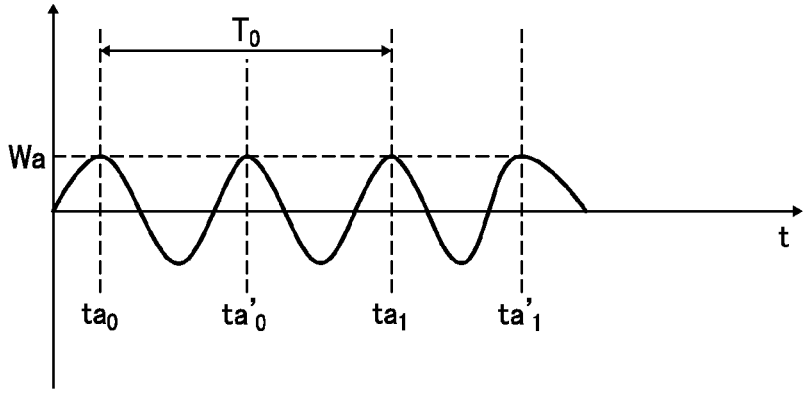
FIG. 14A shows a frequency of vibration caused by the periodical shock at the connecting portion A according to an illustrative embodiment of the present disclosure.
Figure 14B:
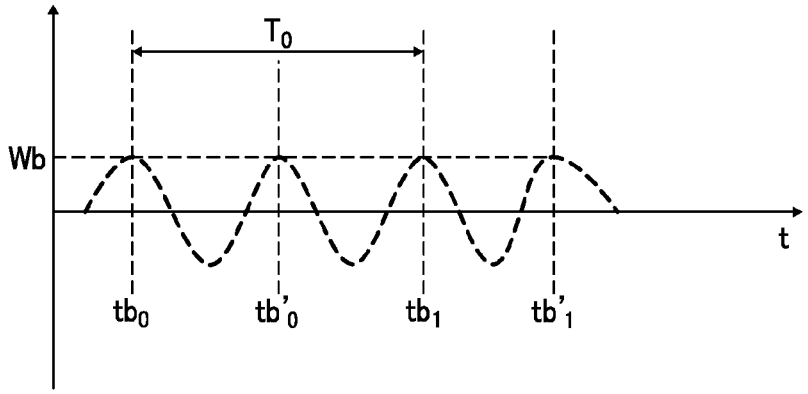
FIG. 14B shows a frequency of vibration caused by the periodical shock at the connecting portion B according to an illustrative embodiment of the present disclosure.
Figure 14C:
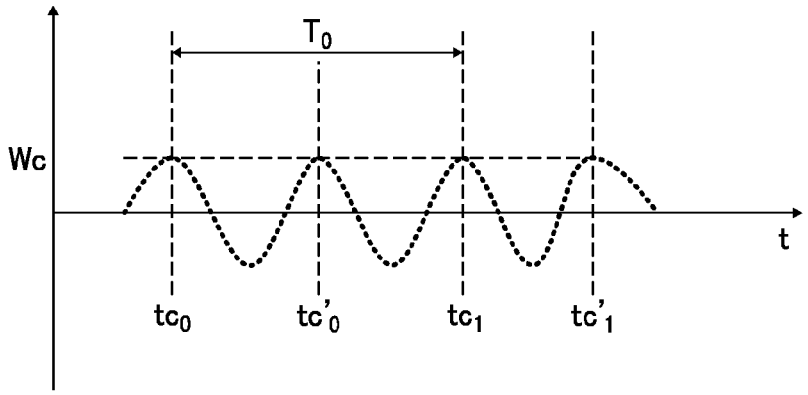
FIG. 14C shows a frequency of vibration caused by the periodical shock at the connecting portion C according to an illustrative embodiment of the present disclosure.

In view of the above, according to the present illustrative embodiment, the peaks ($ta_0$, $ta'_0$, $ta_1$, $ta'_1$, and so forth) of the periodical shock at the connecting portion A constituted of the shaft couplings (couplings) do not overlap with the peaks ($tb_0$, $tb'_0$, $tb_1$, $tb'_1$, and so forth) of the periodical shock at the connecting portion B and the peaks ($tc_0$, $tc'_0$, $tc_1$, $tc'_1$, and so forth) of the periodical shock at the connecting portion C. More specifically, as illustrated in FIGS. 14A through 14C, the angles θa, θb, and θc are determined such that the peaks of the periodical shock at the connecting portions A, B, and C do not overlap with one another, and the position (rotation angle position) on the contact plane of the claws 39*a* and 39*b* on the drive joint 36 in the rotation direction of the drive output shaft 40 is positioned in place.

Figure 15:
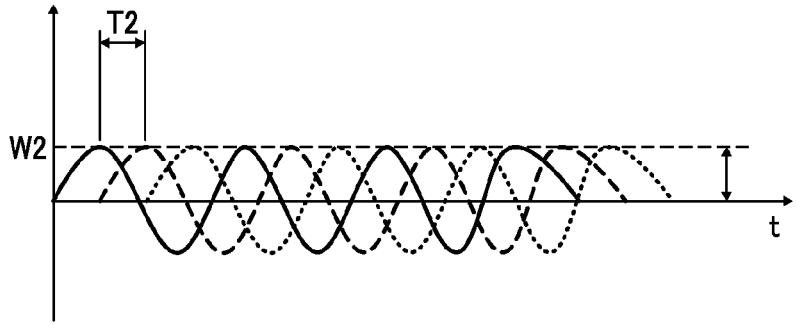
FIG. 15 shows a frequency of vibration generated in the driving force transmission unit according to an illustrative embodiment of the present disclosure.

With this configuration, according to the present illustrative embodiment, as illustrated in FIG. 15, an amplitude W2 of the vibration at the drive output shaft 40 becomes similar to the amplitudes Wa, Wb, and Wc of the vibration occurred at the connecting portions A, B, and C, respectively. Accordingly, the amplitude W2 of the vibration occurred at the drive output shaft 40 can be reduced to one-third as compared with the amplitude W1 (shown in FIG. 13) of the vibration when the peaks of periodical shock at the connecting portions A, B, and C overlap with one another.

According to the present illustrative embodiment, a frequency $F_2$ ($=1/T_2$) corresponding to a cycle $T_2$ of the vibration occurred at the drive output shaft 40 (time intervals of the peaks of periodical shock at each of the connecting portions A, B, and C) is configured to be out of a natural frequency fb of the bracket 31 supporting the drive output shaft 40. More specifically, the angles θa, θb, and θc are determined such that the cycle $T_2$ of the vibration generated at the drive output shaft 40 is out of an integral multiple of the natural frequency fb, and the rotation angle position on the contact plane of the claws 39*a* and 39*b* on the drive joint 36 is positioned in place.

In other words, the integral multiple of the frequency $F_2$ is configured to be out of the integral multiple of the natural frequency fb. With this configuration, sympathetic vibration that occurs when the frequency $F_2$ coincides with or is near the natural frequency of the bracket 31 supporting the drive output shaft 40 is suppressed, thus preventing intensification of the vibration of the driving force transmission unit caused by the sympathetic vibration.

Preferably, at least one of the following Equations 1 and 2 is satisfied. In both Equations 1 and 2, α represents a frequency shift coefficient.

$$f_2 > fb + \alpha \qquad \text{Equation 1}$$

$$f_2 < fb - \alpha \qquad \text{Equation 2}$$

According to the present illustrative embodiment, $f_2$ is approximately 100 Hz, and fb is approximately 130 Hz. Hence, it is desirable that the following relation be satisfied:

$$15\ \text{Hz} \le \alpha \le 20\ \text{Hz}.$$

According to the present illustrative embodiment, the equation 2 is satisfied.

It is to be noted that the description is provided using the bracket 31 as an example. However, the same can be said with respect to the natural frequencies of other constituent parts in the driving force transmission unit 300 such as the drive output shaft 40 and the drive joint 36.

According to the present illustrative embodiment, the cycle $T_2$ of the vibration generated at the drive output shaft 40 is out of a meshing cycle Tg at other connecting portions, that is, at the meshing portions at which the motor gear 32, the idler gear 33, the drive gear 34, and so forth mesh on the driving force transmission path. More specifically, the angles θa, θb, and θc are determined such that the integral multiple of the cycle $T_2$ of the vibration occurred at the drive output shaft 40 is out of the integral multiple of the meshing cycle Tg, and the rotation angle position on the contact plane of the claws 39*a* and 39*b* on the drive joint 36 is positioned in place.

With this configuration, sympathetic vibration that occurs when the cycle $T_2$ of the vibration at the drive output shaft 40 overlaps with the meshing cycle Tg is suppressed, thus preventing intensification of the vibration of the driving force transmission unit 300 caused by the sympathetic vibration.

Preferably, at least one of the following equations 3 and 4 is satisfied. In both Equations 3 and 4, β represents a frequency shift coefficient.

$$f_2 > fg + \beta \qquad \text{Equation 3}$$

$$f_2 < fg - \beta \qquad \text{Equation 4}$$

According to the present illustrative embodiment, $f_2$ is approximately 100 Hz, and fg is approximately 70 Hz. Hence, preferably, the following relation is satisfied:

$$10\ \text{Hz} \le \beta \le 15\ \text{Hz}.$$

According to the present illustrative embodiment, Equation 3 is satisfied.

According to the present illustrative embodiment, the peaks of the periodical shock at each of the connecting portions A, B, and C do not overlap with one another. As a result, the time intervals of the peaks of the periodical shock at each of the connecting portions A, B, and C, that is, the cycle $T_2$ of the vibration at the drive output shaft 40 is shorter than the cycle $T_1$ which is the cycle when the peaks of the periodical shock at each of the connecting portions A, B, and C overlap with one another.

The longer is the cycle of the vibration at the drive output shaft 40, the smaller is the frequency of the vibrations. Consequently, the integral multiple of the frequency easily coincides with the natural frequency of other structures such as the natural frequency fb of the bracket 31, or the integral multiple of the frequency takes easily an approximate value of the natural frequency of other structures.

Similarly, as the cycle of the vibration at the drive output shaft 40 gets longer, the cycle easily coincides with the integral multiple of the meshing frequency Tg of the meshing portions on the driving force transmission path, or the cycle takes easily an approximate value of the integral multiple of the meshing cycle Tg. As a result, the probability of sympathetic vibration gets higher.

In view of the above, according to the illustrative embodiment, with the configuration in which the peaks of the periodical shock generated at each of the connecting portions A, B, and C do not overlap with each other, the probability of sympathetic vibration can be reduced, thereby preventing effectively abnormal operations due to vibration.

As illustrated in FIGS. 9 through 11, in a case in which the angles θa, θb, and θc have different angles, while the drive output shaft 40 rotates once the time intervals of the peaks of the shock at each of the connecting portions A, B, and C are not even. In this case, the peaks of the shock at each of the connecting portions A, B, and C do not overlap, thereby suppressing amplification of the vibration at the drive output shaft 40. However, the rotation of the drive output shaft 40 fluctuates easily.

In view of the above, by making the angles θa, θb, and θc have the same angle, the time intervals of the peaks of the shock at each of the connecting portions A, B, and C while the drive output shaft 40 rotates once are substantially even, thereby preventing the fluctuation of the rotation of the drive output shaft 40. Accordingly, the required rotary driving force can be reduced, hence reducing energy consumption and achieving smooth rotary drive. Furthermore, the greater is the number of peaks of the shock generated while the drive output shaft 40 rotates once, the more the polygonal error can be reduced, thereby achieving more smooth rotary drive.

According to the present illustrative embodiment, the number of claws of the drive joint 36 is two. However, the number of claws is not limited to two. The number of claws may be three or more.

The shape and the structure of the connecting portions of the drive joint 36 and the driven joint (the shape and the structure of the contact portions and the contact target) are not limited to the claws as described above. Any other suitable shapes and structures may be employed. For example, the connecting portions may comprise an involute spline, an Oldham coupling, a gear connection, and so forth.

[Variation 1]

Figure 16:
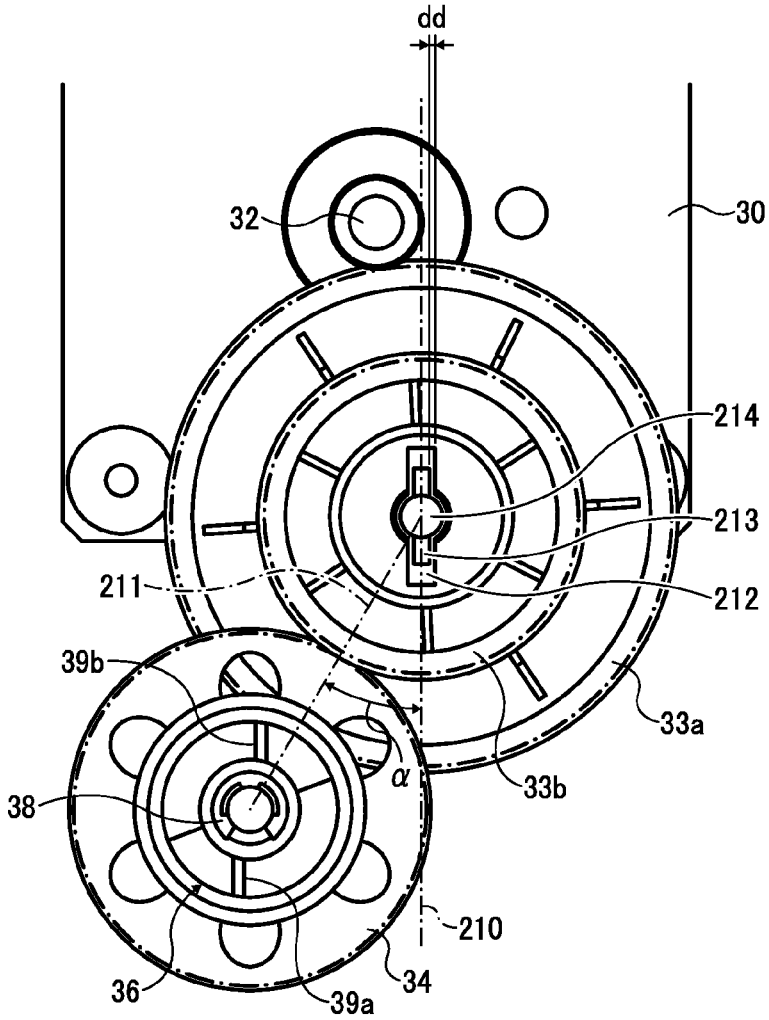
FIG. 16 is a front view schematically illustrating a variation of the driving force transmission unit as viewed from the axial direction of an output shaft of a motor.

With reference to FIG. 16, a description is provided of a variation of the driving force transmission unit. FIG. 16 illustrates a front view of the main component of the driving force transmission unit as viewed from the axial direction of the output shaft of the motor 30 according to Variation 1.

According to the illustrative embodiment, as described above, the connecting portions A, B, and C are configured such that the peaks of shock at the connecting portions A, B, and C do not overlap, and the rotation center axes of the connecting portions A, B, and C are concentrically disposed. By contrast, according to Variation 1, the connecting portions that are configured such that the peaks of shock at the connecting portions do not overlap with each other includes a connecting portion, the rotation center axis of which is not disposed concentrically.

According to Variation 1, in addition to the peaks of the shock at the connecting portions A, B, and C, the peaks of the shock generated at a connecting portion D having a rotation center axis on the rotary shaft of the idler gear 33 do not overlap with the peaks of the shock at the connecting portions A, B, and C.

The surface of the small-diameter idler gear 33*b* of the idler gear 33 includes a fixation pin groove 212 extending in a direction perpendicular to a rotary shaft 214. A fixation pin 213 is fitted to the fixation pin groove 212 with play. The fixation pin 213 is attached integrally to the rotary shaft 214 in such a manner that the fixation pin 213 projects in the radial direction of the rotary shaft 214 of the idler gear 33. The rotary shaft 214 of the idler gear 33 is formed integrally with the large-diameter idler gear 33*a*.

With this configuration, as the large-diameter idler gear 33*a* rotates, causing the rotary shaft 214 of the idler gear 33 to rotate, the small-diameter idler gear 33*b* also rotates. That is, the rotary shaft 214 of the idler gear 33 (or the large-diameter idler gear 33*a*) and the small-diameter idler gear 33*b* constitute the connecting portion D at which the rotary driving force of the large-diameter idler gear 33*a* is transmitted to the small-diameter idler gear 33*b*.

It is to be noted that in FIG. 16, the reference character "dd" refers to a gap (gap in the direction perpendicular to the long direction of the fixation pin groove 212) between the fixation pin groove 212 of the small-diameter idler gear 33*b* and the fixation pin 213 on the rotary shaft 214 on the imaginary plane perpendicular to the axial direction of the rotary shaft 214. The gap dd is provided to the connecting portion D at which the rotary shaft 214 and the small-diameter idler gear 33*b* are connected, thereby connecting (assembling) easily the small-diameter idler gear 33*b* to the rotary shaft 214 using the fixation pin 213.

Similar to the connecting portion B, at the connecting portion D, an inner wall (contact portion) of the fixation pin groove 212 of the small-diameter idler gear 33*b* contacts two projecting portions (contact targets) of the fixation pin 213 projecting beyond the rotary shaft 214 in the radial direction, thereby transmitting the driving force. However, due to the gap dd and the like, the two projecting portions of the fixation pin 213 alternately contact the inner wall of the fixation pin groove 212, causing the projecting portions of the fixation pin 213 to collide with the inner wall of the fixation pin groove 212. This collision of the projections and the inner wall causes a shock in every half period of the rotation cycle of the drive output shaft 214.

In Variation 1, the diameter of the small-diameter idler gear 33*b* is the same as the diameter of the drive gear 34. The gear ratio of these gears is 1. Therefore, a rotation cycle $T_0'$ of the rotary shaft 214 of the idler gear 33 is the same as the rotation cycle $T_0$ of the drive output shaft 40. The time intervals of the peaks of the periodical shock generated at the connecting portion D are the same as the time intervals of the peaks of the periodical shock generated at the connecting portions A, B, and C. Thus, when the peaks of the periodical shock generated at each of the connecting portions A, B, C, and D overlap, the amplitude of the vibration transmitted to the bracket 31 of the driving force transmission unit 300 becomes even greater than that when the peaks of the shock generated at the connecting portions A, B, and C overlap.

In view of the above, in Variation 1, the peaks ($ta_0$, $ta'_0$, $ta_1$, $ta'_1$, and so forth) of the periodical shock generated at the connecting portion A do not overlap with the peaks of the periodical shock generated at other connecting portions B, C, and D. With this configuration, vibration of the bracket 31 of the driving force transmission unit can be suppressed reliably.

The above description relates to a case in which the rotation cycle at the connecting portions that are configured in such a manner that the peaks of the shock at each of the connecting portions do not over lap is the same rotation cycle. However, the rotation cycle does not need to be the same.

In one aspect of the present disclosure, a driving force transmission unit includes a first driving rotary body including a plurality of first contact portions, a first driven rotary body including a plurality of first contact targets, a second driving rotary body, and a second driven rotary body. The first driving rotary body includes a plurality of first contact portions, to receive a driving force from a drive source and rotate. The first driven rotary body includes a plurality of first contact targets, one of which contacts one of the plurality of first contact portions to receive the driving force from the first driving rotary body so as to be rotated. The second driving rotary body includes a plurality of second contact portions, to receive the driving force and rotate. The second driven rotary body includes a plurality of second contact targets, one of which contacts one of the plurality of second contact portions to receive the driving force from the second driving rotary body so as to be rotated. The first driving rotary body, the first driven rotary body, the second driving rotary body, and the second driven rotary body are disposed on a driving force transmission path along which the driving force from the drive source is transmitted to a drive target. As one of the first contact portions and one of the first contact targets contact, the first contact portion different from the previous first contact portion alternately contacts the first contact target different from the previous first contact target. As one of the second contact portions and one of the second contact targets contact, the second contact portion different from the previous second contact portion alternately contacts the second contact target different from the previous second contact target. Each of the plurality of the first contact portions and each of the plurality of the first contact targets are disposed such that peaks of periodical shock generated as the first contact portion different from the previous first contact portion contacts the first contact target different from the previous first contact target do not overlap with peaks of periodical shock generated as the second contact portion different from the previous second contact portion contacts the second contact target different from the previous second contact target.

With this configuration, even when there is an axial deviation at a place where the first contact portion and the first contact target meet, and/or where the second contact portion and the second contact target meet, amplification of vibration is reduced, if not prevented entirely.

In another aspect of the present disclosure, in the driving force transmission unit, time intervals of the peaks of the periodical shock generated at a first connecting portion at which the first contact portion and the first contact target meet as the first contact portion and the first contact target contact are substantially the same as time intervals of the peaks of the periodical shock generated at a second connecting portion at which the second contact portion and the second contact target meet as the second contact portion and the second contact target contact.

With this configuration, fluctuation of rotation is prevented.

In another aspect of the present disclosure, the driving force transmission unit includes a rotary body support to support the rotary bodies, for example, the first driving rotary body, the first driven rotary body, the second driving rotary body, and the second driven rotary body. An integral multiple of the time intervals of the peaks of the periodical shock generated at the first connecting portion and an integral multiple of the time intervals of the peaks of the periodical shock generated at the second connecting portion are out of an integral multiple of a natural period corresponding to a natural frequency of the rotary body support.

With this configuration, amplification of vibration caused by the vibration due to the periodical shock at the first and the second connecting portions and sympathetic vibration with the rotary body support is prevented.

In another aspect of the present disclosure, the driving force transmission unit further includes a driving gear and a driven gear to mesh with the driving gear on the driving force transmission path. Teeth of the driving gear and teeth of the driven gear mesh with each other at a predetermined tooth mesh frequency at a gear mesh portion to transmit the driving force to the driven gear. The integral multiple of the time intervals of the peaks of the periodical shock generated at the first connecting portion and the integral multiple of the time intervals of the peaks of the periodical shock generated at the second connecting portion are out of an integral multiple of the tooth mesh frequency at the gear mesh portion.

With this configuration, sympathetic vibration induced by the frequency of vibration caused by the periodical shock at the first and the second connecting portions overlapped on the tooth mesh frequency is prevented.

In another aspect of the present disclosure, an image forming apparatus includes an image bearing member to rotate and bear an image on a surface thereof, a transfer device to transfer the image on the image bearing member onto a recording medium, a sheet conveyor to rotate and transport the recording medium, and the driving force transmission unit to rotate at least one of image bearing member and the sheet conveyor. With this configuration, imaging failure derived from vibration generated in the driving force transmission unit is prevented.

In another aspect of the present disclosure, the image forming apparatus further includes a chassis to support the driving force transmission unit. Time intervals of the peaks of the periodical shock generated at a first connecting portion at which the first contact portion and the first contact target meet as the first contact portion and the first contact target contact are substantially the same as time intervals of the peaks of the periodical shock generated at a second connecting portion at which the second contact portion and the second contact target meet as the second contact portion and the second contact target contact. An integral multiple of the time intervals of the peaks of the periodical shock generated at the first connecting portion and an integral multiple of the time intervals of the peaks of the periodical shock generated at the second connecting portion are out of an integral multiple of a natural period corresponding to a natural frequency of the chassis.

With this configuration, amplification of vibration caused by the vibration due to the periodical shock at the first and the second connecting portions and sympathetic vibration with the chassis is prevented, hence preventing imaging failure.

In another aspect of the present disclosure, in the image forming apparatus, at least one of supported members supported by the chassis includes a meshing portion at which the plurality of contact portions provided to the drive-source rotary body meshes sequentially with the plurality of contact targets provided to the drive-target rotary body at a predetermined meshing cycle so as to transmit the driving force to the drive-target rotary body. The meshing portion includes, for example, a gear transmission device and a timing belt transmission device. The integral multiple of the time intervals of the peaks of the periodical shock generated at the first connecting portion and the integral multiple of the time intervals of the peaks of the periodical shock generated at the second connecting portion are out of an integral multiple of the mesh frequency at the meshing portion.

With this configuration, sympathetic vibration induced by the frequency of vibration caused by the periodical shock at the first and the second connecting portions overlapped on the mesh frequency of the meshing portion disposed outside the driving force transmission device is prevented.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A driving force transmission unit, comprising:

a first driving rotary body including a plurality of first contact portions, to receive a driving force from a drive source and rotate;

a first driven rotary body including a plurality of first contact targets, one of which alternately contacts one of the plurality of first contact portions to form a first connecting portion therebetween and receive the driving force from the first driving rotary body so as to be rotated;

a second driving rotary body including a plurality of second contact portions, to receive the driving force and rotate; and a second driven rotary body including a plurality of second contact targets, one of which alternately contacts one of the plurality of second contact portions to form a second connecting portion therebetween and receive the driving force from the second driving rotary body so as to be rotated;

the first driving rotary body, the first driven rotary body, the second driving rotary body, and the second driven rotary body being disposed on a driving force transmission path along which the driving force from the drive source is transmitted to a drive target, wherein each of the plurality of the first contact portions and each of the plurality of the first contact targets are disposed such that peaks of periodical shock generated as the first connecting portion changes from one to another do not overlap with peaks of periodical shock generated as the second connecting portion changes from one to another.

2. The driving force transmission unit according to claim 1, wherein time intervals of the peaks of the periodical shock generated at the first connecting portion as the first contact portion and the first contact target contact are substantially the same as time intervals of the peaks of the periodical shock generated at the second connecting portion as the second contact portion and the second contact target contact.

3. The driving force transmission unit according to claim 2, further comprising a rotary body support to support the first driving rotary body, the first driven rotary body, the second driving rotary body, and the second driven rotary body, wherein an integral multiple of the time intervals of the peaks of the periodical shock generated at the first connecting portion and an integral multiple of the time intervals of the peaks of the periodical shock generated at the second connecting portion are out of an integral multiple of a natural period corresponding to a natural frequency of the rotary body support.

4. The driving force transmission unit according to claim 2, further comprising:

a driving gear; and a driven gear to mesh with the driving gear on the driving force transmission path, wherein teeth of the driving gear and teeth of the driven gear mesh with each other at a predetermined tooth mesh frequency at a gear mesh portion to transmit the driving force to the driven gear, and wherein the integral multiple of the time intervals of the peaks of the periodical shock generated at the first connecting portion and the integral multiple of the time intervals of the peaks of the periodical shock generated at the second connecting portion are out of an integral multiple of the tooth mesh frequency at the gear mesh portion.

5. An image forming apparatus, comprising:

an image bearing member to rotate and bear an image on a surface thereof;

a transfer device to transfer the image on the image bearing member onto a recording medium;

a sheet conveyor to rotate and transport the recording medium; and the driving force transmission unit of claim 1 to rotate at least one of image bearing member and the sheet conveyor.

6. The image forming apparatus according to claim 5, further comprising a chassis to support the driving force transmission unit, wherein time intervals of the peaks of the periodical shock generated at the first connecting portion at which the first contact portion and the first contact target meet as the first contact portion and the first contact target contact are substantially the same as time intervals of the peaks of the periodical shock generated at the second connecting portion at which the second contact portion and the second contact target meet as the second contact portion and the second contact target contact, and wherein an integral multiple of the time intervals of the peaks of the periodical shock generated at the first connecting portion and an integral multiple of the time intervals of the peaks of the periodical shock generated at the second connecting portion are out of an integral multiple of a natural period corresponding to a natural frequency of the chassis.

* * * * *